US009322165B2

(12) United States Patent
Luhtala

(10) Patent No.: US 9,322,165 B2
(45) Date of Patent: Apr. 26, 2016

(54) DYNAMICALLY ADJUSTABLE ACOUSTIC PANEL DEVICE, SYSTEM AND METHOD

(71) Applicant: Erik J. Luhtala, San Diego, CA (US)

(72) Inventor: Erik J. Luhtala, San Diego, CA (US)

( * ) Notice: Subject to any disclaimer, the term of this patent is extended or adjusted under 35 U.S.C. 154(b) by 0 days.

(21) Appl. No.: 14/803,611

(22) Filed: Jul. 20, 2015

(65) Prior Publication Data

US 2016/0024783 A1 Jan. 28, 2016

Related U.S. Application Data

(60) Provisional application No. 62/029,000, filed on Jul. 25, 2014.

(51) Int. Cl.
*E04B 1/99* (2006.01)
*E04B 1/84* (2006.01)

(52) U.S. Cl.
CPC .. *E04B 1/994* (2013.01); *E04B 1/84* (2013.01)

(58) Field of Classification Search
CPC ..... E04B 1/994
USPC ..... 181/30, 287, 295
See application file for complete search history.

(56) References Cited

U.S. PATENT DOCUMENTS 1,825,465 A * 9/1931 MacDonald ..... E04B 1/994 181/30
1,975,604 A * 10/1934 Hanson ..... E04B 1/994 181/287
3,049,190 A * 8/1962 Coffman ..... E04B 1/994 160/114
3,382,947 A * 5/1968 Biggs ..... E04B 1/994 181/30
3,450,185 A 6/1969 Holloway
3,469,354 A 9/1969 Meetze, Jr.
3,590,354 A * 6/1971 Shiflet ..... E04B 1/994 181/30
4,276,954 A * 7/1981 Romano ..... E06B 7/084 160/236
4,356,880 A 11/1982 Downs (Continued)

FOREIGN PATENT DOCUMENTS

CN 20267239 1/2013
WO 9209766 6/1992
WO 2013134340 9/2013

OTHER PUBLICATIONS

International Search Report and Written Opinion for PCT/US2015/041685, Korean Intellectual Property Office, Sep. 25, 2015, 10 pages.

(Continued)

*Primary Examiner* — Jeremy Luks
(74) *Attorney, Agent, or Firm* — Procopio Cory Hargreaves & Savitch LLP

(57) ABSTRACT

A dynamic passive acoustic panel device comprises an enclosure having a front opening, an absorbent panel of sound absorbent material mounted in the enclosure behind the front opening, and a reflective surface mounted in the front opening in front of the absorbent panel. The reflective surface comprises a tessellated array of reflective panels of matching shape arranged in a series of rows, each row being mounted for rotation about a central axis so as to vary the angle of inclination of the reflective panels in each row relative to the absorbent panel from zero degrees to ninety degrees to the absorbent panel, so as to vary the reflection and absorption characteristics of the panel device. A control system controls rotation of the rows of reflective panels, so as to vary the reflection and absorption levels between maximum reflection and maximum absorption based on desired acoustic properties of a space in which the panel device is located.

20 Claims, 16 Drawing Sheets

(56) References Cited

U.S. PATENT DOCUMENTS

| | | | | |
|---|---|---|---|---|
| 4,875,312 | A | 10/1989 | Schwartz | |
| 6,006,476 | A * | 12/1999 | Zarnick | E04B 1/994 52/144 |
| 6,431,312 | B1 | 8/2002 | D'Antonio | |
| 7,352,874 | B2 | 4/2008 | Raptopolous et al. | |
| 7,600,608 | B2 | 10/2009 | Freiheit | |
| 7,905,323 | B2 | 3/2011 | Larsen | |
| 8,028,791 | B2 * | 10/2011 | Kliegle | E04B 1/8236 181/287 |
| 8,615,970 | B2 | 12/2013 | Hoberman et al. | |
| 2007/0267248 | A1 | 11/2007 | Gudim | |
| 2010/0198426 | A1 | 8/2010 | Kondo et al. | |
| 2014/0299407 | A1 * | 10/2014 | Caimi | E04B 9/001 181/287 |

OTHER PUBLICATIONS

Print Screens 1 to 4 of [flux]bel ceiling panel model downloaded on Feb. 9, 2016 and originally published on website http://www.research.luhtalas.com/flux_bel.html, May 2011.

Screen Shots of [flux]bel ceiling panel model from a video shown at a Gallery Show by Erik Luhtala in May 2011 and also provided as a link at http://www.research.luhtalas.com/flux_bel.html, May 2011.

* cited by examiner 54
12
46
12
46
12
46
12
46
12
45
12
46
12
46
12
46
12
46

DYNAMICALLY ADJUSTABLE ACOUSTIC PANEL DEVICE, SYSTEM AND METHOD

BACKGROUND

1. Related Field

The subject matter discussed herein relates generally to control of acoustics within an interior space in a building, and is particularly concerned with a dynamic acoustic panel device, system and method.

2. Related Background

The acoustics of built spaces have a significant impact on the subjective perception of the quality of a space. Even spaces with proper acoustic design for a specific use often fail when subjected to the wide range of sound sources and levels required by modern multi-use venues and spaces. Most current systems for dealing with architectural acoustic issues in real-time rely on active acoustics which are electroacoustic solutions composed of microphones and loudspeakers. The limitations of these systems are related to complexity, placement and sophisticated usage. The passive acoustics of a space, which are the physical surfaces surrounding or enclosing the space (e.g. walls, ceiling, and floor) and their composition, contribute greatly to the acoustic characteristics but cannot typically be modified in a real-time or dynamic manner. The physical surfaces may be designed to provide selected passive acoustic properties, i.e. sound absorbing and sound reflecting characteristics, but these properties cannot be changed after installation of the surfaces. No effective systems exist to allow for simple modification of passive acoustics in a dynamic manner.

When designing the passive acoustics of a space, one of the most controllable elements is the reflection of sound within a space. The reflection of sound and its eventual decay is referred to as the reverberation time of a space. To control the reverberation rate of a space, acoustic engineers place reflective or absorptive panels in strategic locations within a space. The level of reflectivity or absorption of these panels is determined by standardized testing which establishes the coefficient of absorption for various materials based on their ability to absorb sound across a spectrum of frequencies.

In scenarios which may require regular re-tuning of room acoustics, e.g. for different types of performances in the space, it is known to use movable systems such as heavy drapes or reflective panels which can be physically changed to match the anticipated use of a space. However, switching from one type of passive acoustic panel to another is time consuming. There is currently no efficient system for quickly varying the level of absorption or reflection of a space to affect the reverberation rate, or to provide a wide range of adjustment so as to increase the reverberation rate potential of a space.

SUMMARY

According to one aspect, a dynamic acoustic panel device comprises a support or enclosure having a front opening, an absorbent panel of sound absorbent material mounted in the enclosure to face the front opening, and a reflective surface mounted in the front opening at a predetermined spacing in front of the absorbent panel, the reflective surface comprising an array of reflective panels arranged in a series of rows across the array, each row being mounted for rotation about an axis so as to vary the angle of inclination of each reflective panel in the row from zero degrees to ninety degrees relative to the absorbent panel. At a zero degree angle, the reflective panels form a flat reflective surface substantially or completely covering the absorbent panel. At a ninety degree angle, the absorbent panel is exposed between adjacent rows of perpendicular panels. Thus, the reflection of the acoustic panel device can be dynamically varied from substantially 100% reflection to as close to 100% absorption as possible to vary the level of reflection versus absorption over a substantially continuous range from 100% to 0% reflection and 0% to 100% absorption.

In one embodiment, the reflective panels are of predetermined matching shapes forming a tessellation or tiling whereby the open front face of the support frame or base is covered by the reflective panels so that there are no overlaps and minimal or no gaps between the panels. The panels may be of triangular, square, hexagonal, diamond or other shapes.

According to another aspect, a dynamic acoustic panel system comprises one or more dynamic acoustic panel devices covering at least parts of the walls and ceiling surrounding an enclosed area such as a room or other space, at least one acoustic sensor associated with the reflective surface of each panel device and configured to monitor sound in the enclosed area, one or more sensor modules receiving input from the sensors and configured to determine a current sound property level of the space such as current sound pressure levels, and a panel control unit which receives the current sound property level and is configured to control the angle of the reflective panels based on a predetermined sound pressure level or desired reverberation rate.

The intent of this proposed design is to achieve a wide range of absorption levels in comparison to a reflective baseline across a range of frequencies, but do so in a dynamic manner. The design utilizes a panelized system controlled by sensors which feed information to a computerized control unit which then drives electromechanical actuators to move components of the panelized system to vary the level of reflection versus absorption of the system.

BRIEF DESCRIPTION OF THE DRAWINGS

The details of various embodiments of a dynamically adjustable acoustic panel device and system, both as to its structure and operation, can be gleaned in part from a study of the accompanying drawings, in which like reference numbers refer to like parts, and in which.

DETAILED DESCRIPTION

Certain embodiments as disclosed herein provide for a dynamic passive acoustic panel for mounting on a wall or ceiling of an enclosed space which is continuously adjustable to vary between a maximum reflection condition and a maximum absorption condition.

The subject matter described herein is taught by way of example implementations. Various details have been omitted for the sake of clarity and to avoid obscuring the subject matter. The examples shown below are directed to devices, systems and methods for controlling acoustics within an interior space in a building. Features and advantages of the subject matter should be apparent from the following description.

After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation.

Figure 1:
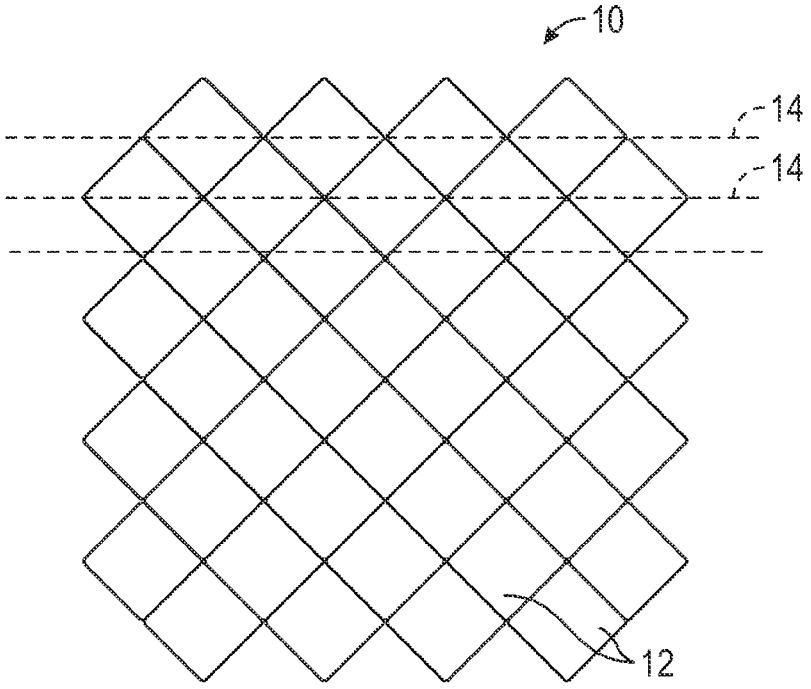
FIG. 1 is a top plan view of one embodiment of a reflective surface formed from a plurality of reflective panels formed in a tessellated or tiled pattern with substantially no overlaps or gaps between reflective panels when in the illustrated flat panel condition.
Figure 2:
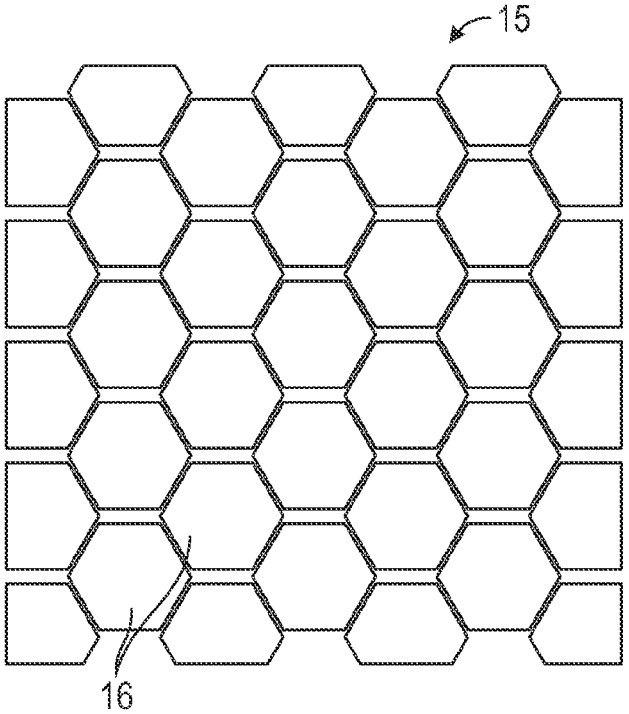
FIG. 2 illustrates a top plan view of another embodiment of a reflective surface formed from reflective panels of a different shape from FIG. 1.
Figure 3:
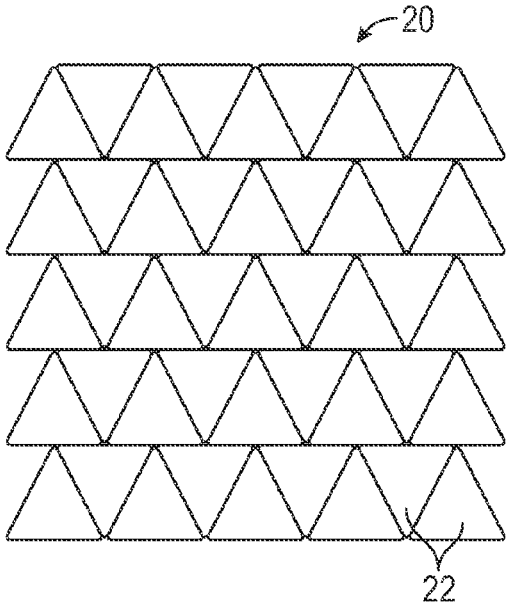
FIG. 3 illustrates a top plan view of another embodiment of a reflective surface formed from reflective panels of a different shape from FIGS. 1 and 2.

FIGS. 1 to 3 illustrate three alternative arrays 10, 15, 20 of reflective panels or plates arranged in a tessellated or tiled pattern so as to reduce space between adjacent panels while avoiding overlap between adjacent panels, while FIGS. 4 to 9 illustrate one embodiment of a dynamic passive acoustic panel device 30 with the tessellated array 10 of reflective panels of the shape shown in FIG. 1 forming a front surface of the device. It will be understood that other reflective panels of different shapes suitable for forming a tessellated array may be used in place of array 10, such as the arrays of FIG. 2 or 3, or other such arrays. Array 10 of FIG. 1 has a plurality of square shaped reflective panels 12 in a tessellated panel with rows of panels arranged on parallel center axes 14 extending between diagonally opposite corners of the panels, as shown in dotted line for three such rows. Thus, the panels of each row are oriented in a diamond-like configuration. Array 15 has reflective panels 16 of hexagonal shape, while array 20 has panels 22 of triangular shape.

Figure 4:
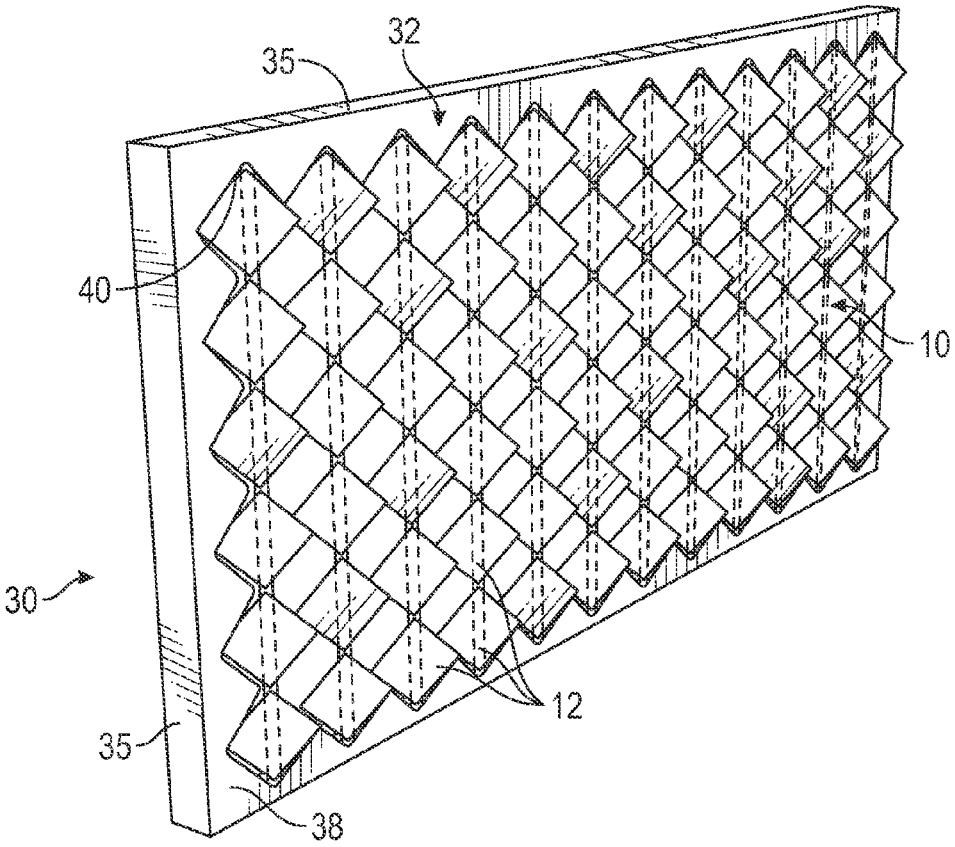
FIG. 4 is a front perspective view of one embodiment of a dynamic passive acoustic panel device having an adjustable reflective front surface formed by reflective panels of the shape shown in FIG. 1, with the panels shown in a rotated, non-flat orientation.
Figure 5:
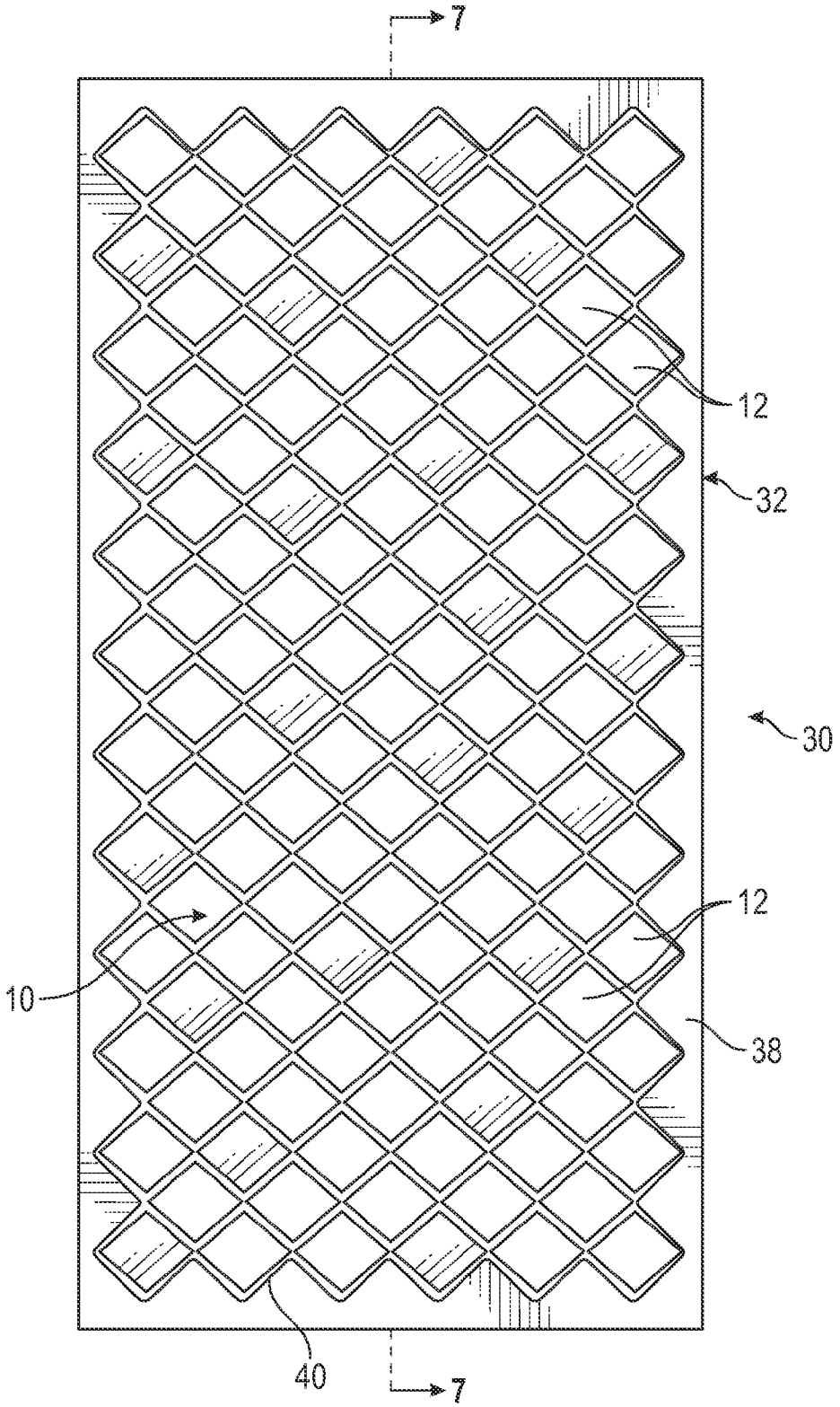
FIG. 5 is a top plan view of the panel device of FIG. 4 with the panels in a flat, fully reflective condition.
Figure 6:
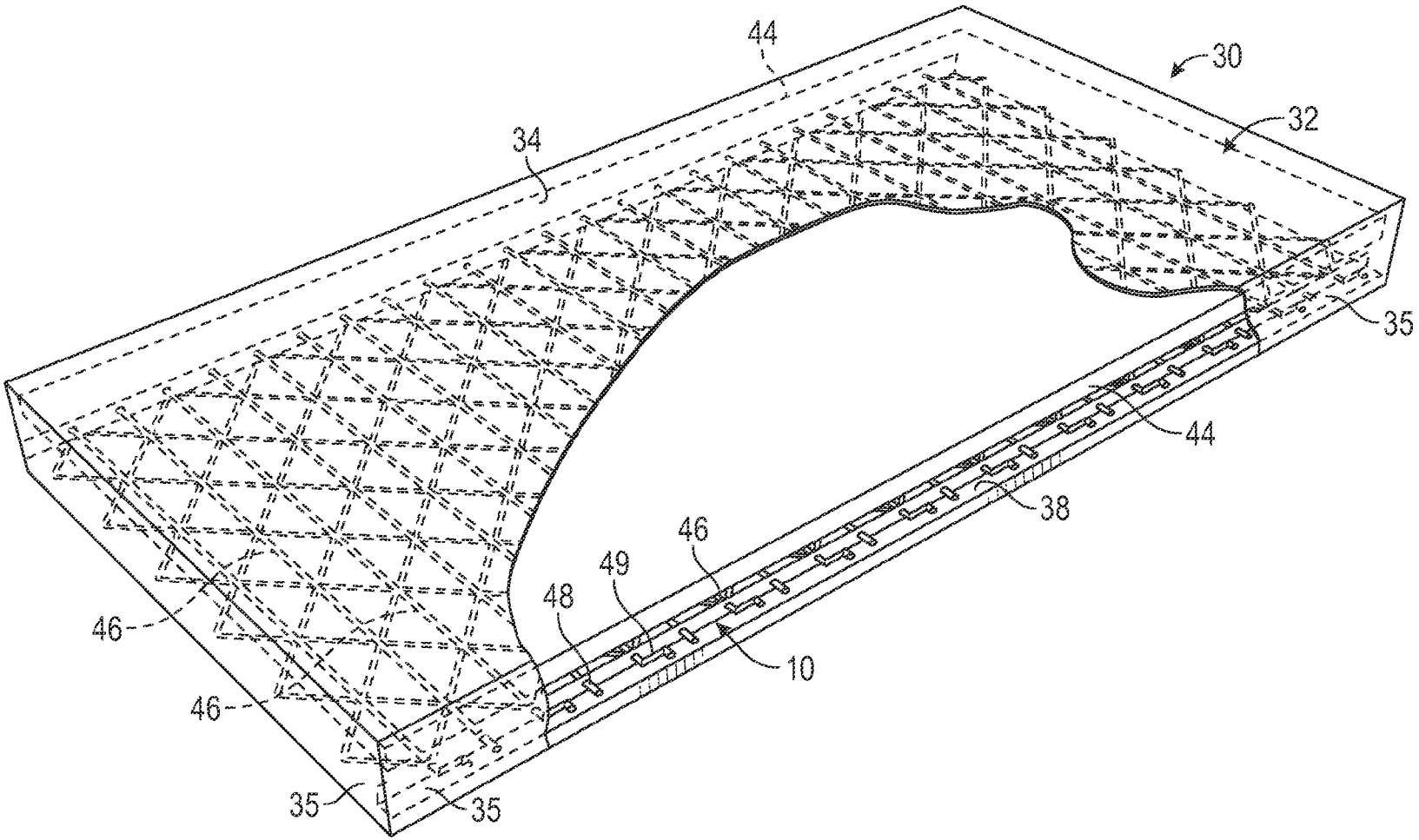
FIG. 6 is a bottom perspective view of the panel device of FIGS. 4 and 5 with the enclosure walls partially cut away to reveal the internal components.
Figure 7:
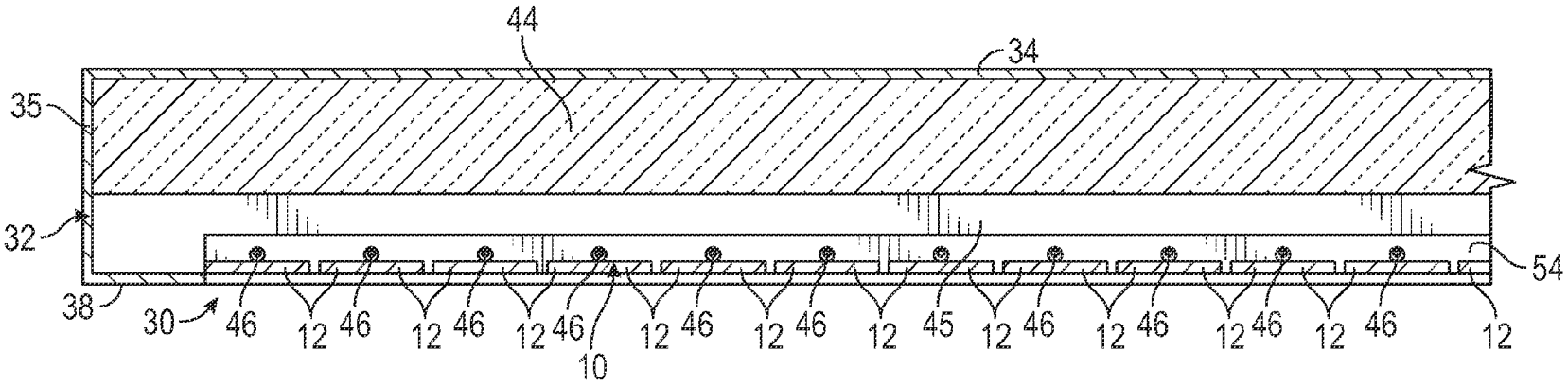
FIG. 7 is a cut away cross-sectional view of the panel device on the lines 7-7 of FIG. 5.
Figure 8:
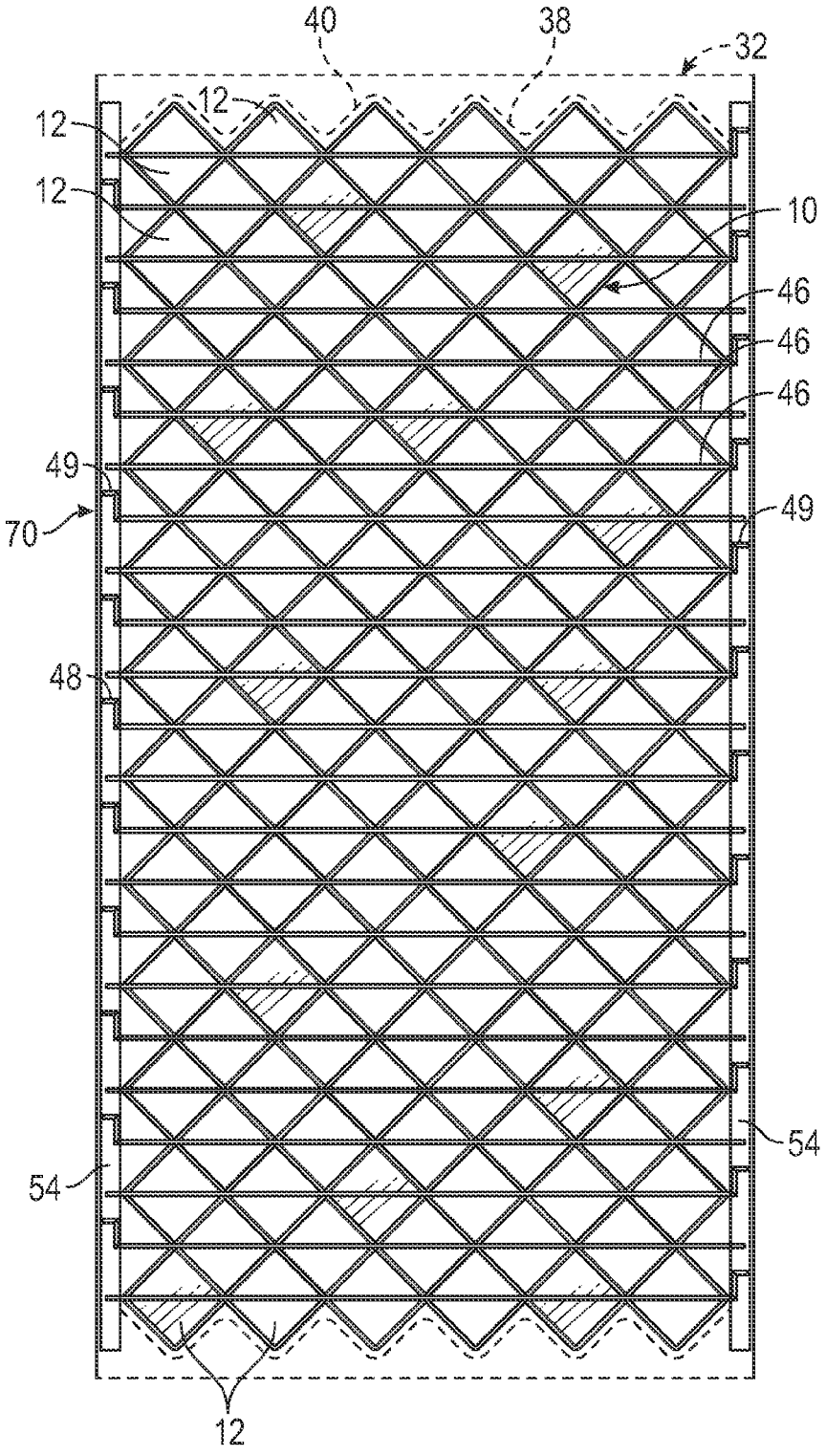
FIG. 8 is a bottom plan view of the reflective panel array of the panel device of FIGS. 4 to 7, illustrating the rotatable mounting structure for the panels.
Figure 9:
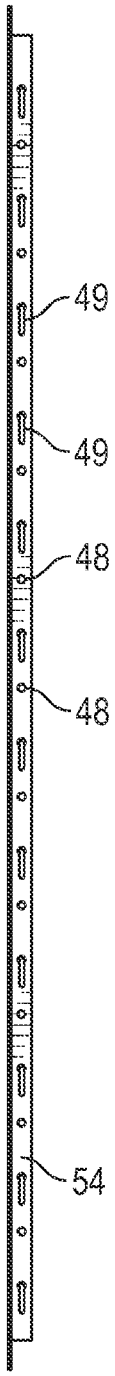
FIG. 9 is a side elevation view of the panel array of FIGS. 4-6.

As illustrated in FIGS. 4 to 9, in one embodiment the dynamic acoustic panel device 30 comprises a support or base in the form of a box-like enclosure or frame 32 having a rear wall or base 34, peripheral side and end walls 35, and a front face 36 which has a peripheral rim 38 defining a front opening 40 for recessed mounting of the array 10 of reflective panels 12 forming a reflective surface 42. A layer 44 of acoustic absorbent material is mounted in enclosure 32 behind surface 42, with a space 45 between the absorbent surface of layer 44 and the array 10. As best illustrated in FIGS. 4, 5 and 7, each row of reflective panels 12 is mounted on a respective axle 46 extending along axis 14 so each panel is rotatable about an axis which extends between diagonally opposite corners of the panel. The rotation is best illustrated in FIG. 4. Opposite ends 48, 49 of each axle are rotatably engaged in mounting brackets 54 running along opposite sides of the enclosure in a direction transverse to the axles, as seen in FIGS. 6 and 7. In the illustrated embodiment, the mounting brackets define channels in which the ends of the axles are located. One end 49 of each axle is suitably linked to a servo drive motor 52 (see FIG. 10) or other drive mechanism which controls rotation of the panels from the flat, fully reflective condition of FIGS. 5, 6 and 9 into a rotated condition at a selected inclined angle, for example as seen in FIG. 4 and as shown schematically in FIGS. 11 and 12B. The axles or pivot rods 14 alternate in direction along each mounting bracket or channel 54, as illustrated in FIGS. 8 and 9, with axle ends 48 alternating with axle ends 49 along each channel. The panels can be inclined at any angle relative to the absorbent surface of absorbent layer 44 from zero degrees (flat, fully reflective condition) to ninety degrees to the underlying absorbent layer (maximum absorbent condition). Although the support for the absorptive panel and panel array is an enclosure with solid walls in the illustrated embodiment, it will be understood that any suitable support may be used in other embodiments, such as a support framework.

Figure 10:
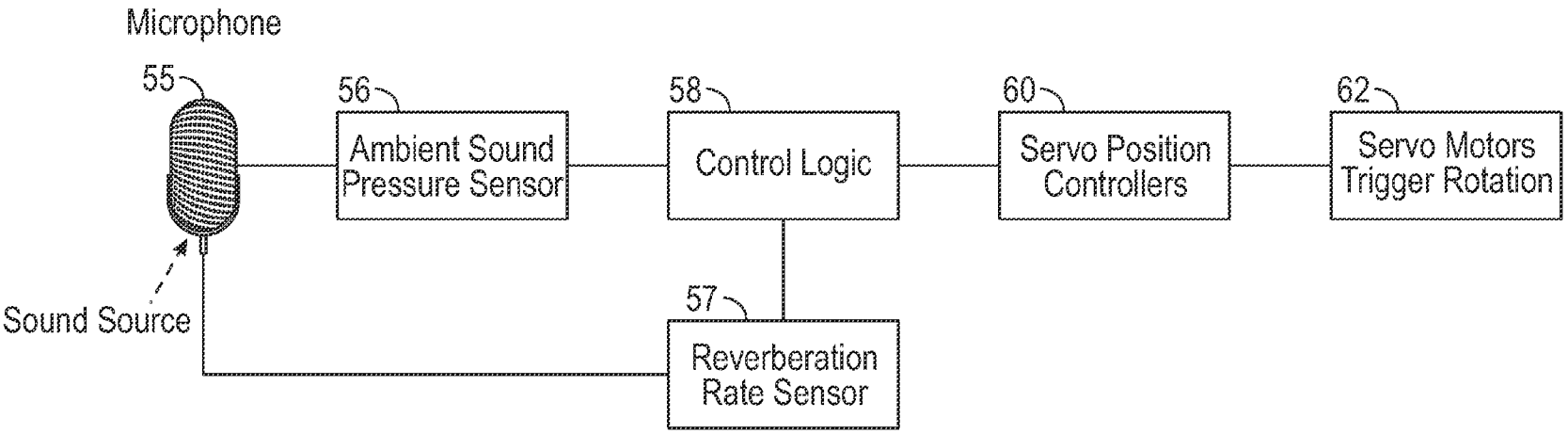
FIG. 10 is a block diagram illustrating one embodiment of a control system for monitoring ambient sound pressure level in a space and controlling the angle of the reflective panels in the front surface of one or more acoustic panel devices mounted on surfaces surrounding the space.

FIG. 10 is a block diagram of one embodiment of a control system 50 for controlling rotation of the reflective panels, as described in more detail below. As the sound levels within the room change, the control system detects these varying levels and adapts the panel angle to control the surface absorbency coefficient of the panel in a dynamic manner, as described in more detail below. Rotation of the panels 12 increases or decreases exposure of the absorptive panel or layer 44 behind the reflective panel array 10, effectively changing the absorption coefficient of the panel as presented to the space. By rotating the individual panels from a zero degree to ninety degree position the level of absorbent materials exposed can be infinitely adjusted. This allows for precise control of the coefficient of absorption of the panel in a real-time manner.

In one embodiment, the enclosure 32 was formed by a frame made of any suitable rigid material such as sheet metal. In one embodiment, the enclosure has a rim 38 around the front of the frame which is laser cut to form an opening 40 to receive the panel array 10. The panel array is designed in a pattern which reduces the gaps around the edge of the rotating surfaces. As seen in FIGS. 8 and 9, the periphery of opening 40 has a zig-zag pattern which substantially matches the zig-zag shape of the periphery of reflective panel array 10, so that the array fits into the opening with minimal gaps between the array and the periphery of the opening when the panels 12 are in the flat, fully reflective condition of FIG. 5. The system may be wrapped in sheet steel to stabilize the frame and seal any gaps.

In one specific example, the fabrication of the reflective surface involved primarily sheet metal work and soldering. In one embodiment, the reflective panels were formed from sheet metal such as sheet steel, for example 10 to 25 ga. mild steel cut into a series of 2"×2" squares to serve as the reflective plates or panels 12. In one embodiment, the panels were formed from 19 ga. mild steel. Each panel row is then joined to ⅛" hot rolled rod which serves as the shaft or axle 46 extending along the center axis 14 of each row of plates or panels. These shaft assemblies were then threaded through side channels or pivot mount brackets 54 of sheet metal bent and perforated for rotatable mounting of the shafts, as indicated in FIGS. 6 and 8. It will be understood that different materials and dimensions may be used in alternative embodiments.

The rotating reflective surface or panel array 10 is mated to the frame or base enclosure 32 which serves to add rigidity to the system as well as to allow mounting of the absorptive panel 44. Any suitable sound absorbing material may be used for panel 44. In one embodiment, the absorptive material may be of fiberglass insulation board or the like, such as Owens Corning 703 1.5 inch or two inch fiberglass insulation board sold by Owens Corning Insulating Systems LLC. Other similar materials may be used in alternative embodiments. In one embodiment, the absorptive panel was mounted one inch behind the reflective surface to allow for panel rotation where the panels are two inch by two inch square panels oriented as illustrated in FIGS. 4 to 8. The entire structure may be enclosed in a rigid material such as 18 ga. mild steel or the like. The one inch gap between reflective panel array 10 and the absorptive panel 44 is designed to allow sufficient space for the panels or plates 12 to be rotated through ninety degrees into an orientation perpendicular to the absorptive panel 44, exposing a maximum amount of the absorptive surface for sound absorption. The completed structure allows the reflective panels to rotate from a zero degree, full reflective position to a ninety degree, full absorptive position.

FIG. 10 illustrates one embodiment of an acoustic panel control system or control logic system 50 for controlling the angle of the reflective panels based on detected ambient sound pressure or other acoustic property of an enclosed area such as a conference or meeting room, performance space, restaurant or the like. Panel devices 30 may be mounted at selected locations on the walls and ceiling surrounding the enclosed area or space. System 50 includes a microphone or ambient sound sensor 55 mounted in each panel device and directed into the area. In one embodiment, the ambient sound sensor 55 may be a microphone mounted on a surface of the panel to capture sound within the space. In one embodiment, the microphone forms a component of a sound sensing system capable of detecting ambient sound pressure level as well as reverberation time of the space, as illustrated in FIG. 10, but other sensors may be used in alternative embodiments. The output of microphone 55 is connected to ambient sound sensor or pressure sensing module 56 and reverberation rate sensor 57 and outputs of pressure sensor 56 and reverberation rate sensor 57 are connected to a control module or control logic unit 58. Sound sensing module 56 processes the output signal to determine the sound pressure level and provides an output related to the ambient sound pressure level to control module 58. In one embodiment, a plurality of sensor outputs from different panels may be processed by ambient sound pressure sensor module 56 to determine current overall ambient sound pressure level or ambient sound pressure detected at the various panel locations. In other embodiments, each panel may be associated with its own ambient sound pressure sensor module to determine ambient sound pressure level at the particular panel location.

In one embodiment, reverberation rate sensor or module 57 is configured to detect reverberation characteristics of the space. Sensor module 57 also uses the outputs of microphones 55 in the panels. In public spaces such as restaurants and cafes, a small amount of reverberation is required to reinforce speech. As the levels of reverberated sound rise these same reverberations combine to become unintelligible noise. This increase in noise is called the noise threshold, the point below which intelligible speech is not possible. In acoustically sensitive spaces such as theaters and orchestral halls, it is desirable to have a longer reverberation time, since longer reverberations serve to enforce the qualities of sound. In this case excess reverberation can be an issue but at longer delay times. The outputs of microphones on each panel are used by the reverberation rate sensor module to detect the reverberation time of the monitored space, and this data is output to controller 58, which uses reverberation time or rate information along with custom mapping or pre-programmed control parameters to adjust the angle of panel elements in order to vary reverberation time so as to enhance listener preference in an acoustically sensitive environment.

Thus, the system of FIG. 10 can respond to either sound pressure level of the room for noise control or to reverberation time of the room to create a better listening environment.

Figure 11:
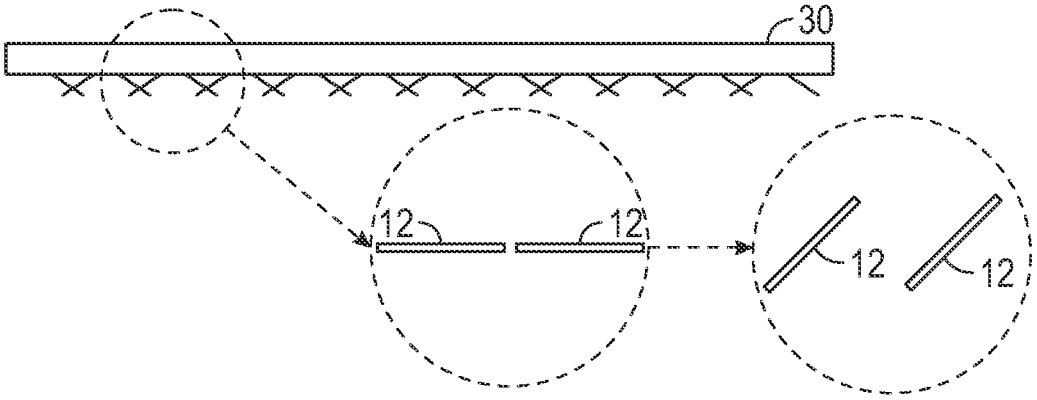
FIG. 11 is a side view of a panel device with circled enlarged views of two side-by-side reflective panels of the device in a closed or fully reflective condition and in a partially open condition.
Figure 12A:
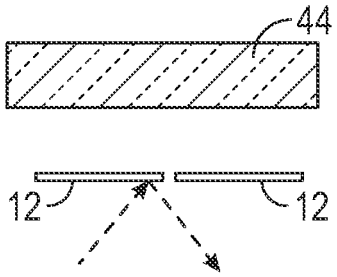
FIGS. 12A and 12B illustrate the fully reflective condition and a partially open condition of two panels of the reflective panel array in more detail.
Figure 12B:
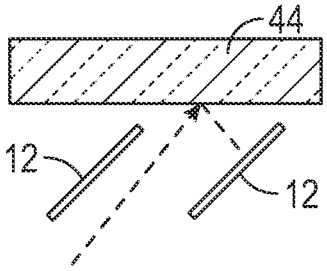
Figure 13:
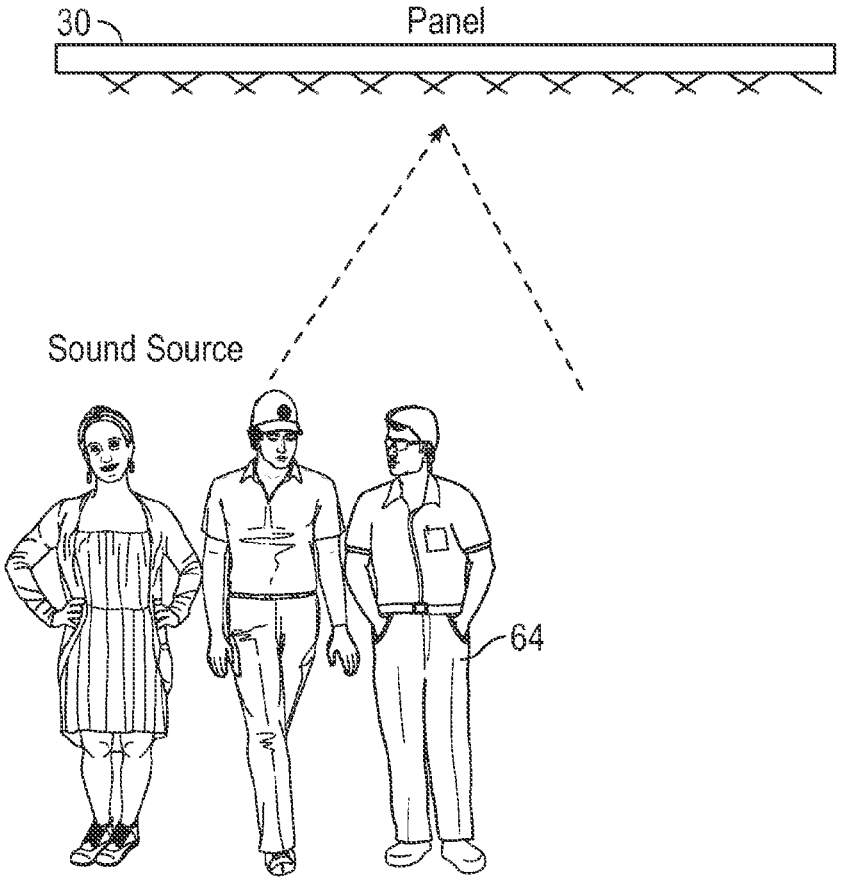
FIG. 13 illustrates a panel device installed in a ceiling, with the reflective panels rotated into a partially open condition to reduce ambient sound pressure level.
Figure 14:
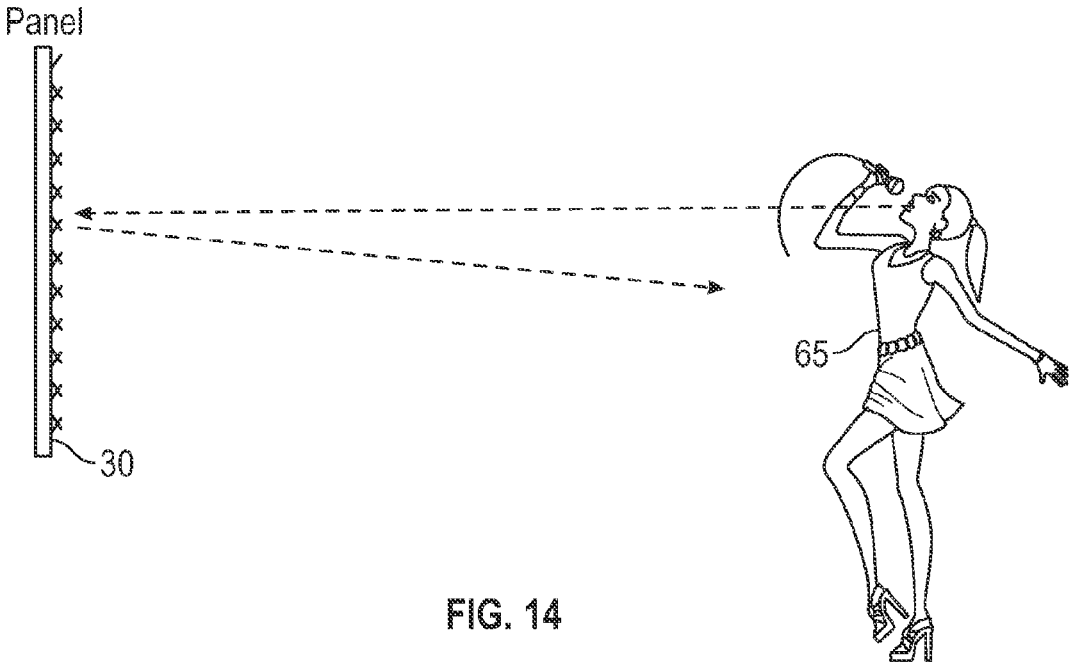
FIG. 14 illustrates a panel device installed on a wall, with the reflective panels in a partially open condition so as to increase the panel absorption coefficient and thus reduce ambient sound pressure level.

The response to the sampled sound may be varied based on pre-programmed control parameters to produce a desired effect of the panels on sound in the space. For example, when a panel system is configured for public spaces, the panels are controlled to be sensitive to an increase in noise threshold, which is the presence of excessive amounts of combined reverberations. The panel angles can then be adjusted to increase absorption and help reduce reverberation, thereby lowering the noise threshold and improving intelligibility of speech. Conversely, as the noise threshold lowers the panels can be returned to a more reflective state to help provide small levels of reverberation to aid in speech clarity Based on the currently detected ambient sound pressure level or reverberation rate (depending on the selected mode of operation), controller or control module 58 provides a control output to servo position control module 60, which actuates the servo motor or motors 62 in order to rotate the reflective panels 12 of the panel device or devices in order to increase or decrease the absorption coefficient of the panel device. If the panel device 30 is in the zero degree, fully reflective mode with maximum sound reflection as seen in FIGS. 11 and 12A, and the detected ambient sound pressure level is above a currently selected maximum level or noise threshold, the servo motor is actuated to rotate the panels to a predetermined angle, as illustrated to the right in FIG. 11 and in FIG. 12B, thus increasing the absorption coefficient of the panel device. This means that some of the incoming sound is absorbed by the parts of the absorbent layer 44 exposed in the openings between adjacent reflective panels, as indicated by the arrow in FIG. 12B, and less sound is reflected. FIG. 13 illustrates an example of a meeting space with a sound source comprising one or more groups 64 of people involved in conversation, with the ambient sound pressure level detected at panel device 30, after which the reflective panels are rotated into a predetermined orientation in order to reduce reflected sound. FIG. 14 illustrates a performer 65 as the sound source with the sound associated with the performance picked up by a sensor associated with panel 30, resulting in adjustment of the reflective panel angle in order to reduce reflected sound pressure level.

The panel system described above is a distinguished by the ability to vary its surface absorbency coefficient dynamically. In the terms of building acoustics, material absorption coefficient is the ability of a material to absorb sound within a space. By changing the sound absorption versus reflection properties of the panel surface, it is possible to control the reverberation time within a space. Reverberation time of a given sound is the amount of time it takes for the sound to decay 60 decibels from the initial peak.

In acoustically sensitive spaces such as theaters, concert halls, conference halls, classrooms, and the like, the panels use the same processing component but the control system is configured to detect reverberation times at specific frequencies. Based on preconfigured information as to room size and performance type, the response can be tuned based on reverberations occurring at certain frequency levels. The goal in this case is to maintain certain reverberation times to create a better listening environment.

In the above embodiment, a series of compound surfaces are repositioned dynamically to expose varying proportions of acoustically reflective and acoustically absorptive surfaces to a room. The varying of the acoustic surface condition dynamically through digital control, as described above in connection with FIGS. 10 to 12B, allows precise tuning of room acoustics. Controller 58 is suitably programmed to dynamically alter room acoustics in real-time to either enhance or absorb direct and reflected sound. The result is improved clarity, user preference and listener comfort. As discussed above, the dynamically adjustable acoustic panel system is composed of adjustably mounted reflective acoustic surfaces as well as light-weight acoustically absorptive surfaces. The adjustable reflective surfaces are manipulated by electronic servo mechanisms 60, 62 and digital controller 58, as illustrated in FIG. 10 and described above. The system can be used to vary the acoustic properties of a built space in real time. This can be applied in situations from conference rooms to restaurants, churches and concert halls to improve listener preference and enhance clarity.

Prior to construction of a first prototype of the dynamic acoustic panel of the above embodiments, the pattern configurations of FIGS. 1 to 3 were digitally tested to determine the most effective pattern which would allow the greatest variance between absorbed and reflected rays. This testing indicated that the pattern of square or diamond shaped reflective panels of FIG. 1 was the most effective of the three options. The initial digital testing was performed in a 3D modeling application using Rhinoceros (a 3-D modeling software application developed by Robert McNeel & Associates), using built-in plug-ins such as the Galapagos plug-in, which allow for the creation of custom tools within the program. The testing engine was a custom-written ray trace algorithm constructed specifically for this purpose.

The panels were tested by allowing Galapagos to rotate each axis a potential 360 degrees. Fitness of any potential solution was judged by their ability to range from 100% reflection to as close to 100% absorption as possible. The Galapagos plug-in virtually rotated each array until the angles that achieved the lowest level of reflection were determined. As an evolutionary problem solver Galapagos does this in an automated manner and provides a best-possible solution based on the fitness desired. The highest fitness levels were used to determine which prototypes were performing successfully.

To normalize results across various scenarios multiple tests were performed to define initial values for the ray trace algorithm until levels were obtained where no system achieved 100% absorption. This reduced or prevented inaccuracies within the system by being able to achieve non-zero values from each system with standardized base values. Once initial testing was done to normalize values it was shown that rotation angles from zero to ninety degrees were able to encompass the entire breath of performance for all systems tested. For this reason, subsequent testing involved a maximum of ninety degrees of rotation for testing. Following successful digital testing the next step was the development of a physical prototype. Digital testing results indicated that the reflective panel array of square panels oriented as illustrated in FIG. 1 and FIG. 4 would be the best selection of the three options in FIGS. 1 to 3. The completed configuration in one embodiment allowed external access to the rotation mechanism for manipulation of the reflecting surfaces. For the initial testing purposes the actuation was manual. The physical prototype was modeled based on the results of the digital testing. The materials for the tested panel system were standardized materials with known acoustic properties. A mild steel reflective panel and rigid fiberglass acoustic panel were used for the prototype testing but any two materials with a wide range of absorption coefficient could be utilized, such as aluminum with mineral wool batting.

The tessellated reflective surface was designed as a system of panels attached to rotating axles to allow for varied levels of reflectivity with an absorbent acoustic board mounted behind the panel array, as illustrated in FIGS. 4 to 7.

Figure 15A:
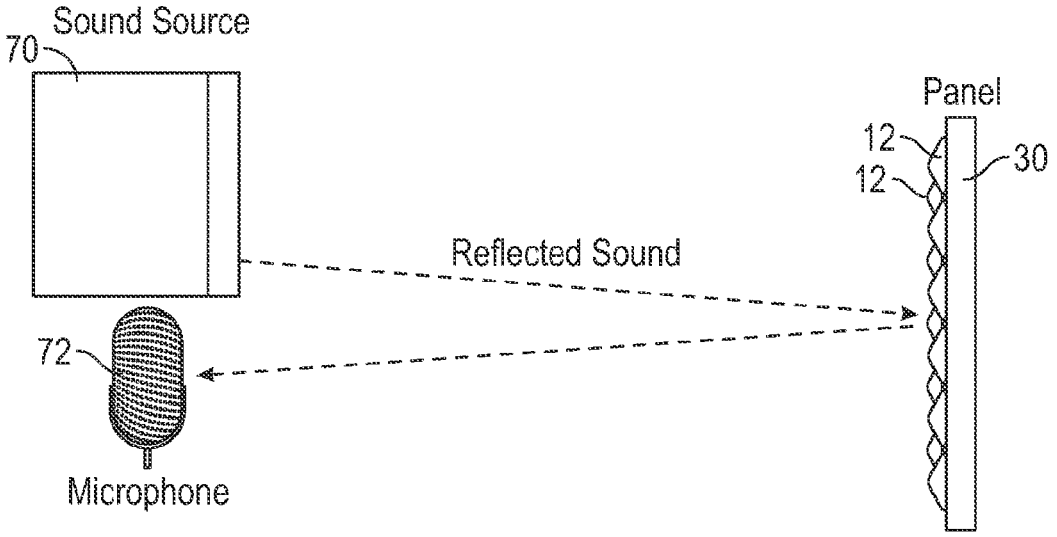
FIGS. 15A and 15B are elevation and plan views, respectively, of a panel testing layout.
Figure 15B:
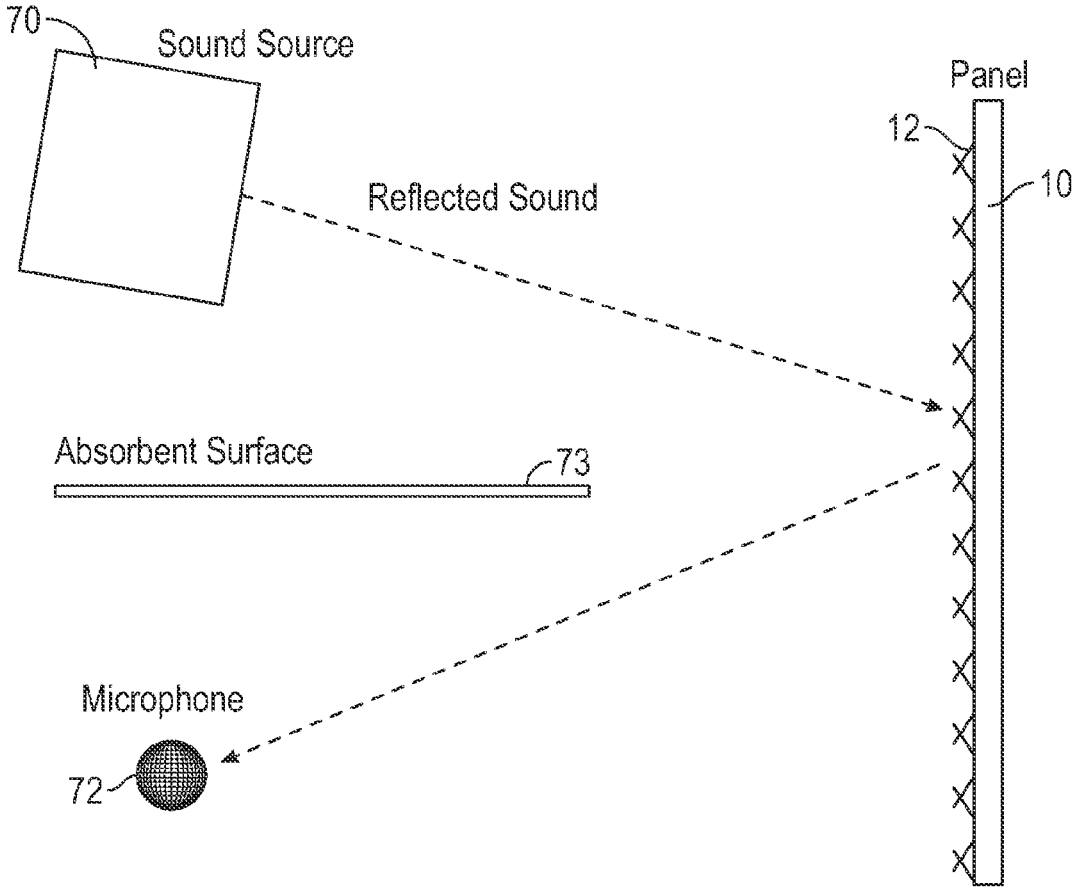

The testing methodology involved placing the panel 30 in an acoustically dampened room of approximately 300 square feet as illustrated in FIGS. 15A and 15B, and directing a sound source 70 at the panel, with the reflected signal picked up by a microphone or sound sensor 72. A sound pressure level sensor was utilized with pink and white noise as a source. Additionally, impulse responses were measured to determine decay rates at various panel position settings.

The panel was placed on a stand facing into the space positioned at around twelve inches above floor level. Sound source 70 was a speaker raised 36" above the floor and directed at the panel approximately thirty degrees off of center and at a distance of four feet. The receiving microphone 72 was placed 36 inches above the floor at the reflected angle of the speaker at a distance of approximately four feet.

Figure 16:
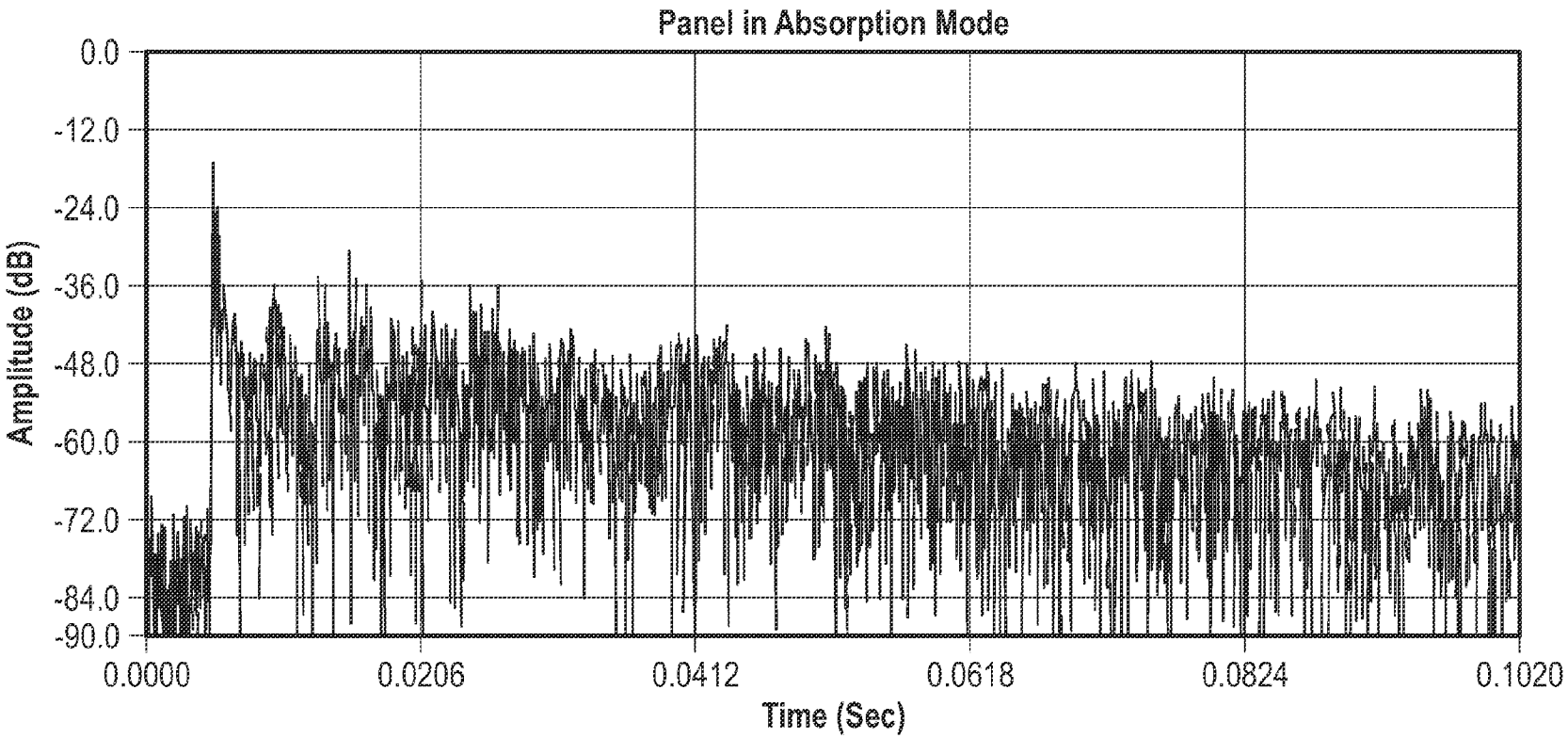
FIG. 16 is a graph illustrating variation in amplitude with time with the panel device in an absorptive mode (with the reflective panels at a ninety degree angle to the underlying acoustic panel)
Figure 17:
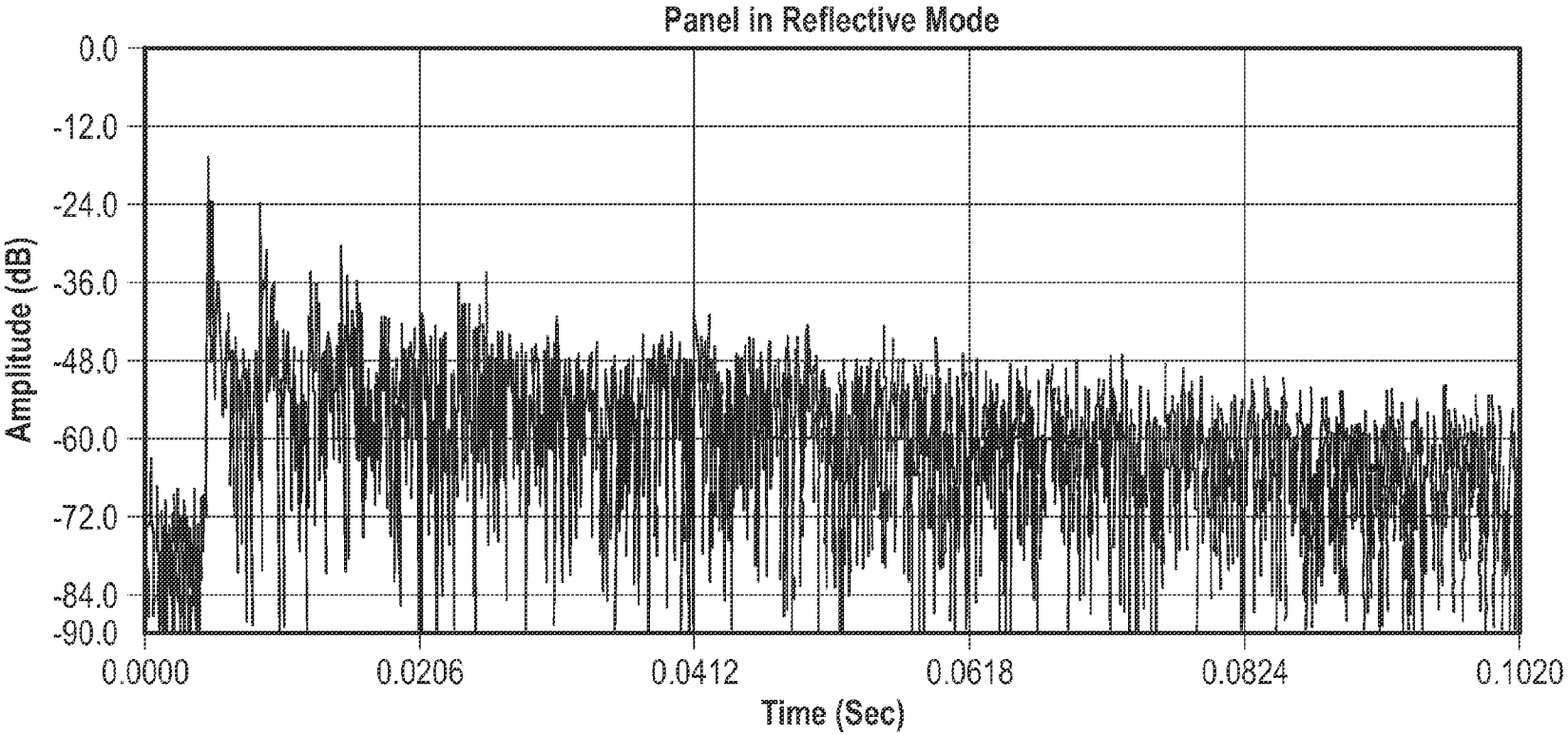
FIG. 17 is a graph illustrating variation in amplitude with time with the panel device in a reflective mode (with the reflective panels oriented flat at zero degrees to cover the underlying acoustic panel)
Figure 18:
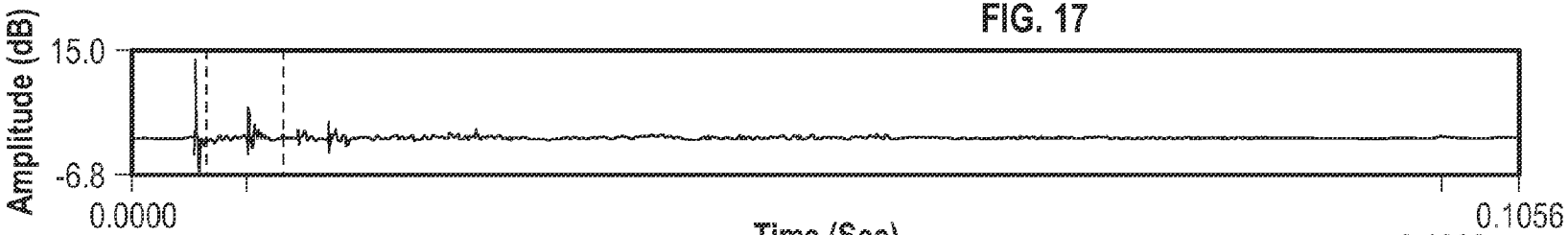
FIG. 18 is a graph illustrating a fast Fourier transform (FFT) of the response with an impulse response window indicated between dotted lines on the response.
Figure 19:
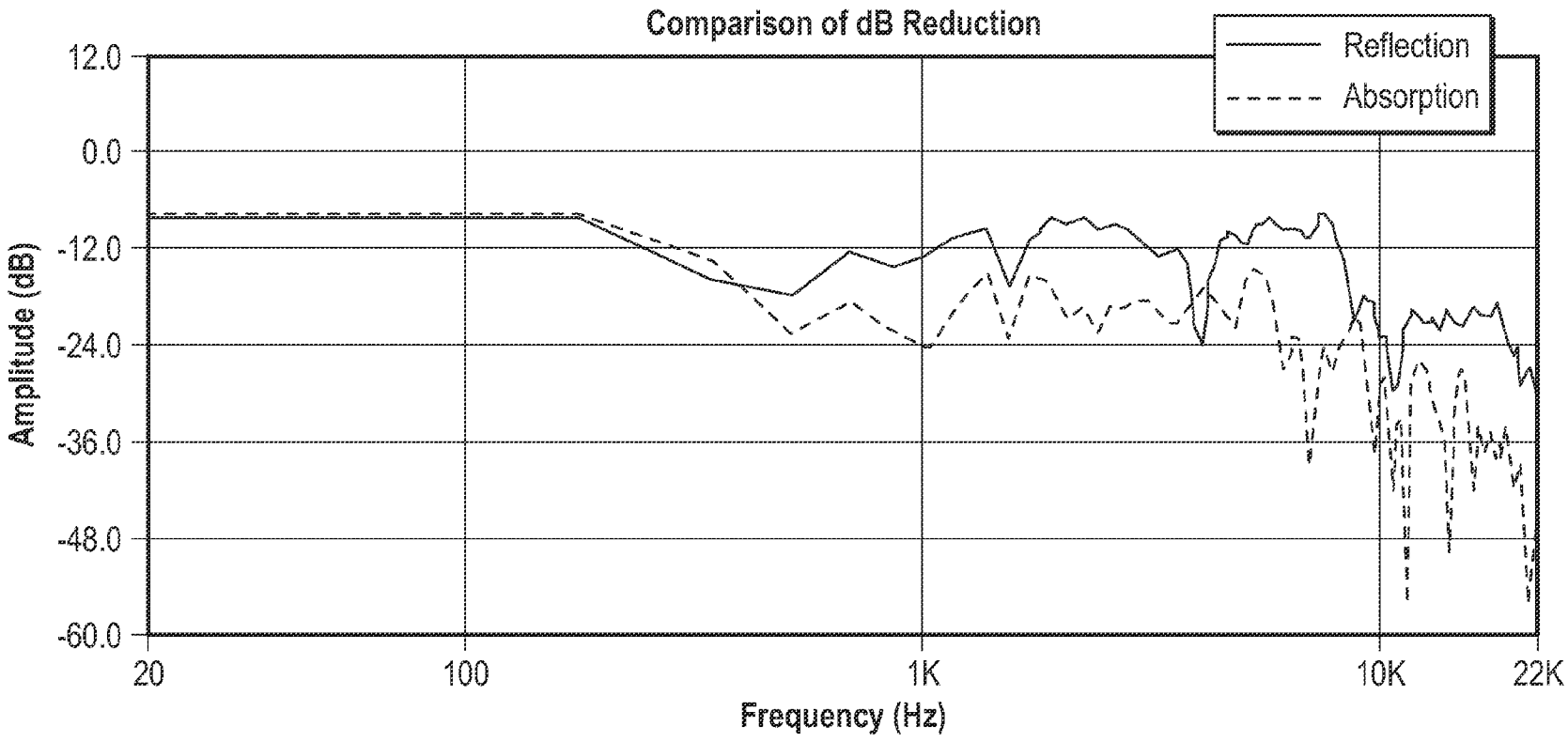
FIG. 19 is a graph with one line illustrating attenuation or dB reduction over a frequency from 20 Hz to 20 KHz in reflection mode of the panel and the other line illustrating attenuation over the same frequency range in absorption mode of the panel.

The audio testing process involved placing the panel in its full reflective mode then running the sound pressure and impulse response test to create baseline readings as illustrated in FIGS. 16 to 18. The panel surface was then rotated to full absorptive mode in thirty degree increments and the identical test was repeated. With this process, additional room reflections could be mapped out of the resultant data, providing an accurate comparison of the panel's performance between the two readings. This allowed for the determination of the level of absorption of the panel in comparison to its full reflective mode (see FIG. 19).

The physical prototype developed allowed for the testing to proceed to real-world conditions. The benefit of this is that even with advanced sound calculations of wave behavior it is still often difficult or computationally prohibitive to analyze systems in only a digital environment. The physical testing allowed results to be gathered under actual conditions.

The physical testing configuration discussed above was fairly simplistic but by utilizing the same test methodology and sophisticated sampling software it was possible to achieve accurate results. The response from the panel in reflective mode (see FIG. 17) was used as a baseline against which to compare the panel placed into its fully absorptive mode (see FIG. 16).

The hypothesis based on the results of the digital testing was that the panel would yield a measurable result but the extent was uncertain as the physical prototype was a first iteration and not constructed to exacting standards. The panel proved very successful by achieving attenuation results between 9 and 14 dB in the octave bands measured. From this it is possible to approximate the absorption coefficient of the panel between 0.90 and 0.95 in the octave bands 1 k to 8 k. Table 1 below illustrates the frequency in Hz (top row) and the corresponding attenuation in dB for a panel tested in the manner described above.

TABLE 1

Table of attenuation values at different frequencies

| Frequency | 31.5 | 63 | 125 | 250 | 500 | 1000 | 2000 | 4000 | 8000 |
|---|---|---|---|---|---|---|---|---|---|
| Attenuation | N/A | N/A | N/A | N/A | N/A | 11.7 | 12.0 | 9.0 | 14.7 |

Figure 20:
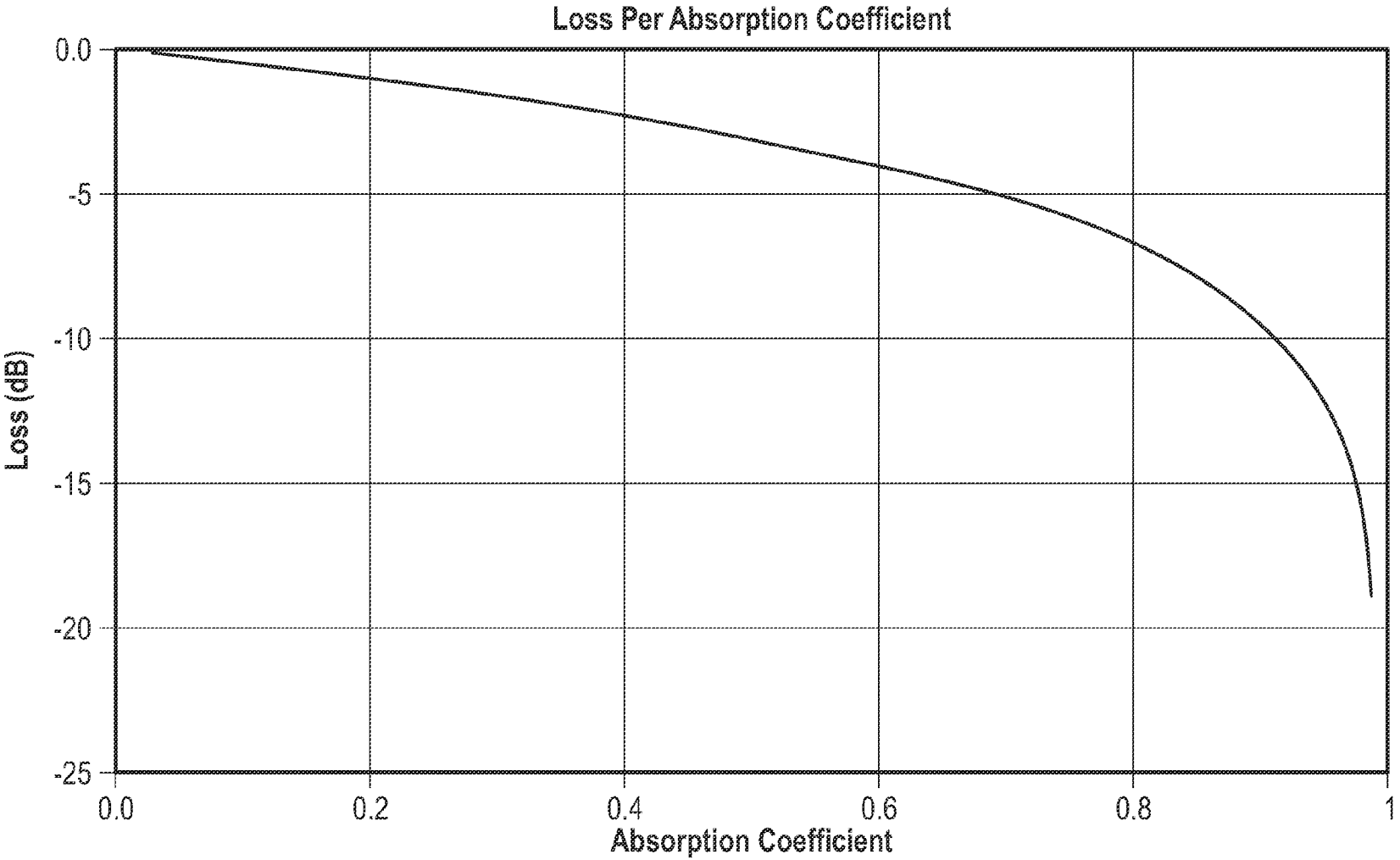
FIG. 20 is a graph illustrating dB loss over a range of absorption coefficients from fully reflective mode to fully absorptive mode of the panel.

The above result indicates that the panel is able to vary its physical properties from those of painted brick to those of 0.75" thick acoustical board. FIG. 20 illustrates the variation in dB loss with changing absorption coefficient, based on known values. The vertical band in dotted line in FIG. 20 indicates the panel in the maximum absorptive mode, i.e. with the reflective panels oriented at ninety degrees to the acoustic layer or panel. It is possible to have a major effect on the acoustics of a space with the range of acoustic properties of the panel, as found in the model testing. Even with anecdotal observation, one can picture being in an entire room of rough concrete or one covered with acoustical board. The key is the ability to make the change in acoustic properties not in a few days or hours by physically changing from one acoustic panel type to another, as was necessary in the past, but instead simply to rotate the reflective panels to achieve a different absorption index with an installed panel device 30, which only takes a few moments. By dynamically altering room acoustics, the panel should be able to have a very measurable effect on the clarity, quality and preference of architectural acoustics.

Figure 21:
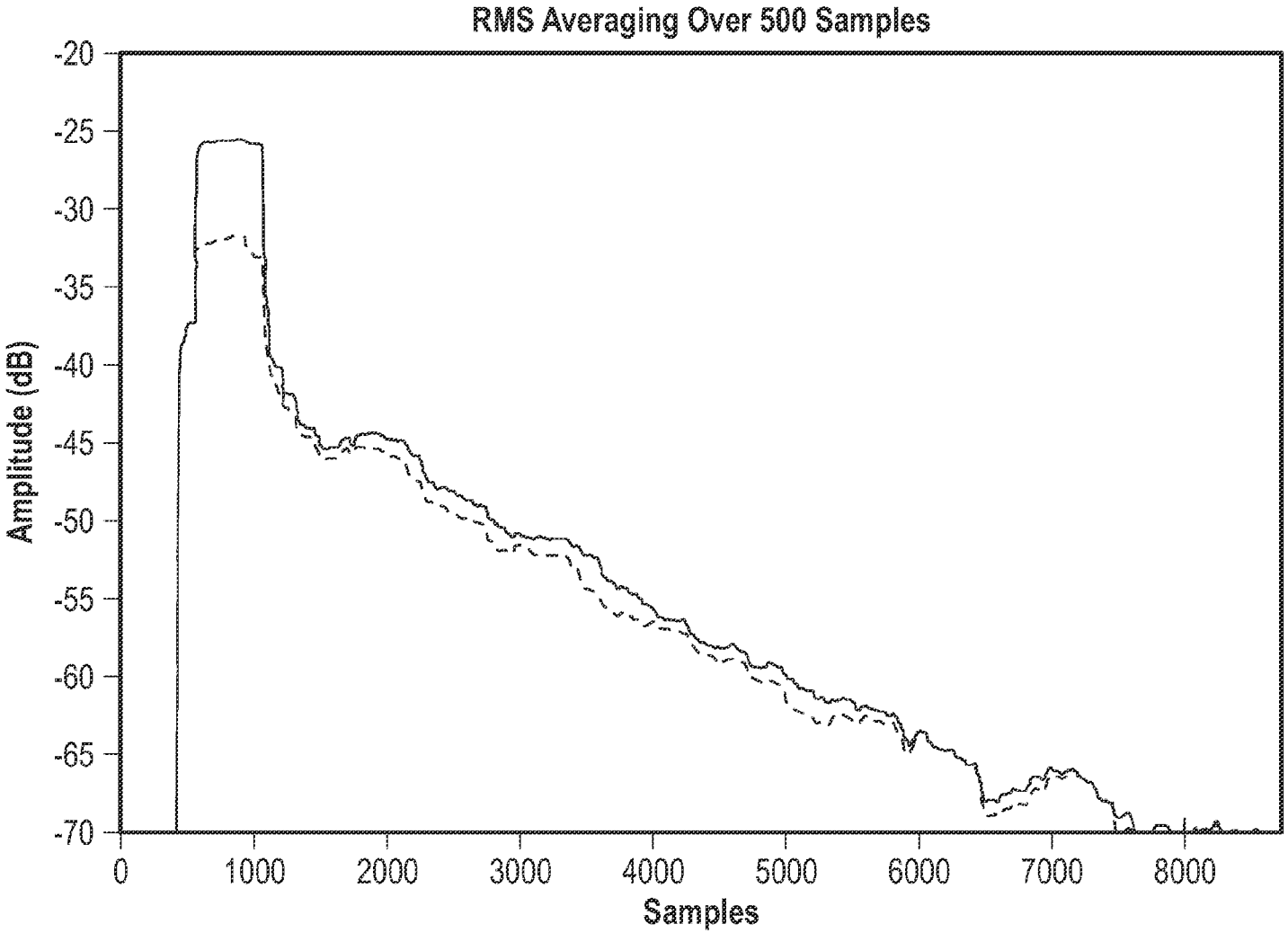
FIG. 21 is a graph comparing test results for noise amplitude with the panel in the closed, reflective condition and in the fully open, absorptive condition.

FIG. 21 shows the panel tested in its fully closed or zero degree position (solid line) as well as in the fully open or ninety degree position (dashed line). The ninety degree position is the fully absorptive position and this shows a 7 dB drop compared to the zero degree or fully reflective position. This is a substantial reduction in impulse.

Figure 22:
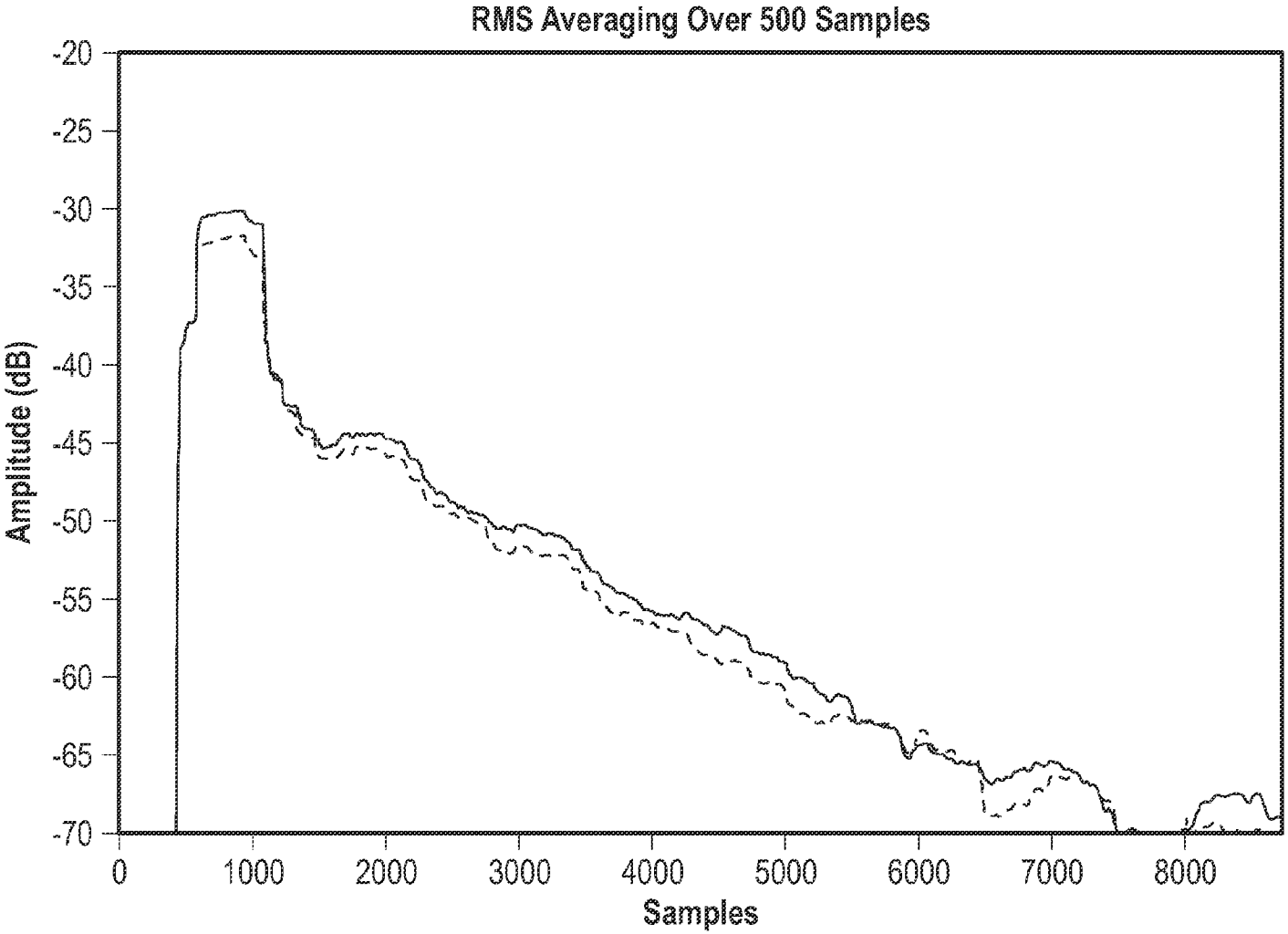
FIG. 22 is a graph comparing test results for noise amplitude of the panel in the open condition to a baseline of a plain acoustic absorber.

FIG. 22 compares the ninety degree or fully absorptive position (solid line) with an acoustic absorption reference material (dashed line), in this case two inch thick Owens Corning 703 acoustic board, which is the same material which serves as the acoustic absorbent layer 44 within the acoustic panel device 30. Interestingly, the results of second graph show an improvement in absorption capability over the reference material. This shows that the absorption ability of the panel system exceeds that of a simple panel of the same absorbent material used within the panel device.

With knowledge of the panel's performance, it is possible to calculate the effect of the panel on different architectural installations. The most common measure of room performance acoustically is reverberation rate. With knowledge of the reverberation rate within a space, and comparison of that reverberation rate with the anticipated sound source, it is possible to determine if the room creates reverberation times within user preference ranges. For example, in a space with unamplified speech, desired reverberation rates are in the range of 0.8 seconds, whereas in a performance space for symphonic music, desired reverberation rates are around 2.0 seconds. The dynamic acoustic panel system described above allows both reverberation rates to be achieved in the same space, simply by positioning a desired number of panel devices 30 in the space and appropriately controlling the angle of the reflective panels in each panel device.

In a prior art space designed with prior art passive acoustic panels designed for symphonic music, the reverberation rate is excessive if the space is used for unamplified speech, causing muddied and unintelligible speech. By introducing the ability to dynamically vary the absorptive properties of the acoustic panel surfaces, it is possible to change reverberation times in a space in real time, so as to more accurately match what is currently occurring within the space.

The most common calculation used for determining reverberation rate is the Sabine calculation. The calculation produces an estimate of the reverberation rate of a given volume. It also shows that the higher level of absorption coefficient, the greater the effect of the absorptive surfaces on reverberation rate. In a given space, absorption rates can have a large effect on room reverberation. For example, a typical auditorium space 180 feet long by 90 feet wide with a height of 30 feet might have 50% of the interior surfaces covered with acoustic absorbing material. Without any type of treatment and with interior surfaces covered in a material such as wood paneling which has an absorption coefficient of 0.10, a reverberation time of almost 10 seconds is expected. This creates excessive reverberations leading to incomprehensible speech or music.

If the same surface area is covered or at least partially covered by dynamically variable acoustic panel devices as described in the above embodiments, the absorption rate could be altered to an absorption coefficient of 0.94, where the reverberation time would drop to a reasonable rate of 1 second for spoken word. If the spoken word piece was followed immediately by a symphonic production, altering the panels to a 0.50 absorption rate would create a pleasing reverberation rate of 2 seconds.

The key to this functionality is the dynamic nature of the panels. By coupling the panels with an arrayed system of detectors which help to gather and calculate room response rates, the system can respond dynamically to these changing requirements. From concert halls to classrooms, the effect that dynamic acoustic panels can have is clear and the need apparent. The dynamic acoustic panel system described above therefore has the potential for a great impact on the sound quality in many public and private spaces.

It will be understood that the foregoing systems and methods and the associated devices and modules are susceptible to many variations. Additionally, for clarity and concision, many descriptions of the systems and methods have been simplified.

Those of skill will appreciate that the various illustrative logical blocks, modules, units, and algorithm steps described in connection with the embodiments disclosed herein can often be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular constraints imposed on the overall system. Skilled persons can implement the described functionality in varying ways for each particular system, but such implementation decisions should not be interpreted as causing a departure from the scope of the invention. In addition, the grouping of functions within a unit, module, block, or step is for ease of description. Specific functions or steps can be moved from one unit, module, or block without departing from the invention.

The various illustrative logical blocks, units, steps and modules described in connection with the embodiments disclosed herein can be implemented or performed with a processor, such as a general purpose processor, a multi-core processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm and the processes of a block or module described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium. An exemplary storage medium can be coupled to the processor such that the processor can read information from, and write information to, the storage medium. In the alternative, the storage medium can be integral to the processor. The processor and the storage medium can reside in an ASIC. Additionally, device, blocks, or modules that are described as coupled may be coupled via intermediary device, blocks, or modules. Similarly, a first device may be described a transmitting data to (or receiving from) a second device when there are intermediary devices that couple the first and second device and also when the first device is unaware of the ultimate destination of the data.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A dynamic acoustic panel device, comprising:

an enclosure having a base and a single front opening having a peripheral edge;

an absorbent panel of sound absorbent material mounted on the base of the enclosure and having a front face spaced inward from the front opening;

a multi-panel array mounted in the front opening in front of the absorbent panel at a predetermined spacing from the front face of the absorbent panel;

the multi-panel array comprising an array of reflective panels arranged in a series of spaced rows, each row having a central axis extending across the front opening between opposing portions of the peripheral edge of the front opening, the panels in each row being rotatably mounted for rotation about the central axis of the respective row whereby the angle of inclination of each reflective panel in the row is adjustable from zero degrees to ninety degrees relative to the absorbent panel, the multi-panel array forming a substantially flat reflective surface at least substantially covering the absorbent panel in a zero degree position, and each panel in the multiple panel array extending substantially perpendicular to the absorbent panel in a ninety degree position in which the absorbent panel is exposed between adjacent rows of perpendicular panels, whereby the reflection and absorption characteristics of the panel device can be dynamically adjusted by varying the angle of panels in the array to any selected angle from maximum reflection at the zero degree position to maximum absorption at the ninety degree position.

2. The panel device of claim 1, wherein the reflective panels are of predetermined matching shapes and are positioned to form a tessellated pattern which substantially fills the front opening in the zero degree, maximum reflection position with no intervening structure between adjacent panels in the panel device.

3. The panel device of claim 1, wherein the shape of the panels is selected from the group consisting of triangular, square, hexagonal, and diamond shapes.

4. The panel device of claim 2, wherein the tessellated pattern of panels in the zero degree position has a peripheral edge of non-rectangular shape and the peripheral edge of the front opening has a shape which at least substantially matches the peripheral edge of the tessellated pattern.

5. The panel device of claim 4, wherein the peripheral edge of the front opening and the peripheral edge of the tessellated pattern of panels in the zero degree position have matching zig-zag shapes.

6. The panel device of claim 2, wherein the panels each have an outer face and an inner face, and the panel assembly further comprises a plurality of spaced, parallel pivot axles extending across the respective rows of panels and mounting devices, each pivot rod extending along the central axis of the respective row and being secured across the inner faces of the panels in the respective row, and mounting brackets extending along opposite edges of the panel assembly perpendicular to the central axes, opposite ends of the respective pivot rods being rotatably mounted in the mounting brackets for rotation of the panels between the zero degree and ninety degree position.

7. The panel device of claim 1, wherein the predetermined spacing is greater than half the height of a panel in the ninety degree position.

8. The panel device of claim 7, wherein the panels are of square shape and the panels in each row are oriented so that the center axis extends through diagonally opposite corners of each panel.

9. The panel device of claim 8, wherein the predetermined spacing is approximately one inch and the panels are two inch by two inch squares.

10. The panel device of claim 1, wherein the reflective panels are of sheet metal material.

11. The panel device of claim 1, wherein the sound absorbent material is fiberglass insulation board.

12. The panel device of claim 1, wherein adjacent reflective panels in the array have adjacent edges which are positioned side by side with at least substantially no gaps between adjacent edges of the panels in the zero degree position of the array.

13. The panel device of claim 1, wherein there are twelve rows of panels in the array and six panels in each row.

14. A dynamic acoustic panel system, comprising:

one or more dynamic acoustic panel devices covering at least parts of the walls and ceiling surrounding an enclosed area such as a room or other space;

each acoustic panel device comprising an enclosure having a single front opening, an absorbent panel of sound absorbent material mounted inside the enclosure and having a front face spaced from the front opening, and an array of reflective panels rotatably mounted in the front opening in front of the absorbent panel and configured for rotation between a flat, zero degree position in which the panels are aligned to form a substantially flat, tessellated array of reflective panels which at least substantially fills the front opening with no overlap between adjacent panels and a ninety degree position in which each panel extends transverse to the absorbent panel, whereby the reflection and absorption characteristics of the panel device can be adjusted by varying the angle of panels in the array between maximum reflection at the zero degree position and maximum absorption at the ninety degree position;

one or more drive devices configured to rotate the panels to a selected orientation between the zero degree and ninety degree position; and a control unit programmed to control operation of the one or more drive devices to adjust the panel angles.

15. The system of claim 14, further comprising one or more acoustic sensors associated with the respective one or more panel devices, each acoustic sensor configured to monitor a sound property in the enclosed area and having an output related to the monitored sound property, and one or more sensor modules receiving output from the one or more acoustic sensors and configured to determine a current sound property level of the space based on the sound output, the control unit receiving output from the one or more acoustic sensor modules and being configured to control the one or more drive devices to control the angle of the reflective panels in one or more acoustic panel devices based on the current sound property level.

16. The system of claim 15, wherein the one or more sensor modules comprise one or more ambient sound pressure sensors and the control unit is configured to vary the angle of the reflective panels depending on the difference between a detected sound pressure level and a selected sound pressure level for the enclosed space.

17. The system of claim 15, wherein the one or more acoustic sensor modules comprise one or more reverberation rate sensor modules, and the control unit is configured to vary the angle of the reflective panels depending on the difference between a current detected reverberation time and a selected reverberation time for the enclosed area.

18. A method of dynamically controlling acoustic properties within an enclosed space, comprising:

deploying a selected number of acoustic panel devices on surfaces surrounding the enclosed space, each acoustic panel device comprising an enclosure having a single front opening, an absorbent panel of sound absorbent material mounted inside the enclosure and having a front face spaced inward from the front opening, and an array of reflective panels rotatably mounted in the front opening in front of the absorbent panel and configured for rotation between a flat, zero degree position in which the panels are aligned to form a substantially flat, tessellated array of reflective panels which at least substantially fills the front opening with no overlap between adjacent panels and a ninety degree position in which each panel extends transverse to the absorbent panel;

determining a desired acoustic property level for the enclosed space based on a first planned use of the space; and adjusting the angle of the reflective panels in each acoustic panel device to vary the reflective and absorptive levels of the panel devices based on the desired acoustic property level, whereby the acoustic property level of the space is dynamically adjustable for a range of different uses of the space.

19. The method of claim 18, wherein the angle of the reflective panels in each acoustic panel device is adjusted based on comparison between currently determined reverberation rate in the enclosed space and a desired reverberation rate for the enclosed space.

20. The panel device of claim 6, wherein each panel is a two inch by two inch square of reflective metal, the panels in each row are arranged on a respective pivot axle extending between diagonally opposite corners of the panels to form a diamond shape tessellated array, and the absorbent panel has a thickness of 1.5 or 2.0 inches and is spaced one inch from the array of panels in the zero degree position.

* * * * *